US007561837B2

(12) United States Patent
Eck et al.

(10) Patent No.: US 7,561,837 B2
(45) Date of Patent: Jul. 14, 2009

(54) ELECTROGRAPHIC DEVELOPMENT METHOD AND APPARATUS

(75) Inventors: Edward Michael Eck, Lima, NY (US); Thomas Joseph Foster, Geneseo, NY (US)

(73) Assignee: Eastman Kodak Company, Rochester, NY (US)

( * ) Notice: Subject to any disclaimer, the term of this patent is extended or adjusted under 35 U.S.C. 154(b) by 325 days.

(21) Appl. No.: 11/505,182

(22) Filed: Aug. 15, 2006

(65) Prior Publication Data

US 2006/0275055 A1 Dec. 7, 2006

Related U.S. Application Data

(63) Continuation of application No. 10/949,643, filed on Sep. 24, 2004, now Pat. No. 7,120,379.

(60) Provisional application No. 60/506,134, filed on Sep. 26, 2003.

(51) Int. Cl.
*G03G 15/09* (2006.01)

(52) U.S. Cl. ..... 399/267; 399/276; 399/277

(58) Field of Classification Search ..... 399/265, 399/266, 267, 270, 273, 274, 275, 276, 277
See application file for complete search history.

(56) References Cited

U.S. PATENT DOCUMENTS 4,714,046 A 12/1987 Steele et al.
5,095,340 A 3/1992 Mahoney
5,146,278 A 9/1992 Kroll et al.
5,241,327 A 8/1993 Rubin et al.
5,280,302 A 1/1994 Rubin et al.
5,291,259 A 3/1994 Weitzel et al.
5,293,201 A 3/1994 Kamp et al.
5,296,898 A 3/1994 Rubin et al.
5,296,905 A 3/1994 Youset et al.
5,325,161 A 6/1994 Saha et al.
5,347,347 A 9/1994 Hilbert et al.
5,400,124 A 3/1995 Kass et al.
5,491,541 A * 2/1996 Yokoyama et al. ..... 399/277
5,592,268 A 1/1997 Uehara et al.
5,606,404 A 2/1997 Hilbert et al.
6,512,908 B2 1/2003 Mitamura
6,526,247 B2 2/2003 Stelter et al.
6,571,077 B2 5/2003 Thompson et al.

* cited by examiner

*Primary Examiner*—Hoang Ngo
(74) *Attorney, Agent, or Firm*—Donna P. Suchy

(57) ABSTRACT

The invention relates generally to processes for electrographic image development. An electrographic development apparatus is provided wherein a film is adjacent a cylindrical toning shell and a mixture of toner and carrier is particles disposed on the cylindrical toning shell in contact with the film. The cylindrical toning shell is closest to the film at a first location, the mixture of toner and carrier particles being movable through the first location with a flow direction. A magnetic core disposed within the cylindrical toning shell offset toward the cylindrical shell such that a magnetic field strength is greater at the second location than the first location.

31 Claims, 5 Drawing Sheets

ELECTROGRAPHIC DEVELOPMENT METHOD AND APPARATUS

CROSS REFERENCE TO RELATED APPLICATIONS

This is a Continuation of Utility patent application Ser. No. 10/949,643, filed on Sep. 24, 2004, now U.S. Pat. No. 7,120,379 entitled ELECTROGRAPHIC DEVELOPMENT METHOD AND APPARATUS, and Provisional Application Ser. No. 60/506,134 filed Sep. 26, 2003, also entitled "ELECTROGRAPHIC DEVELOPMENT METHOD AND APPARATUS" which is hereby incorporated by reference herein assigned to the Eastman Kodak Company.

BACKGROUND OF THE INVENTION

The invention relates generally to processes for electrographic image development.

Processes for developing electrographic images using dry toner are well known in the art and are used in many electrographic printers and copiers. The term "electrographic printer," is intended to encompass electrophotographic printers and copiers that employ a photoconductor element, as well as ionographic printers and copiers that do not rely upon a photoconductor. Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell.

The developer is deposited on the toning shell and moved into proximity with the imaging member, at a location where the imaging member and the toning shell are in closest proximity, referred to as the "toning nip." In the toning nip, the magnetic carrier component of the developer forms a "nap," similar in appearance to the nap of a fabric, on the toning shell, because the magnetic particles form chains of particles that rise from the surface of the toning shell in the direction of the magnetic field.

DETAILED DESCRIPTION OF THE INVENTION

Figure 1:
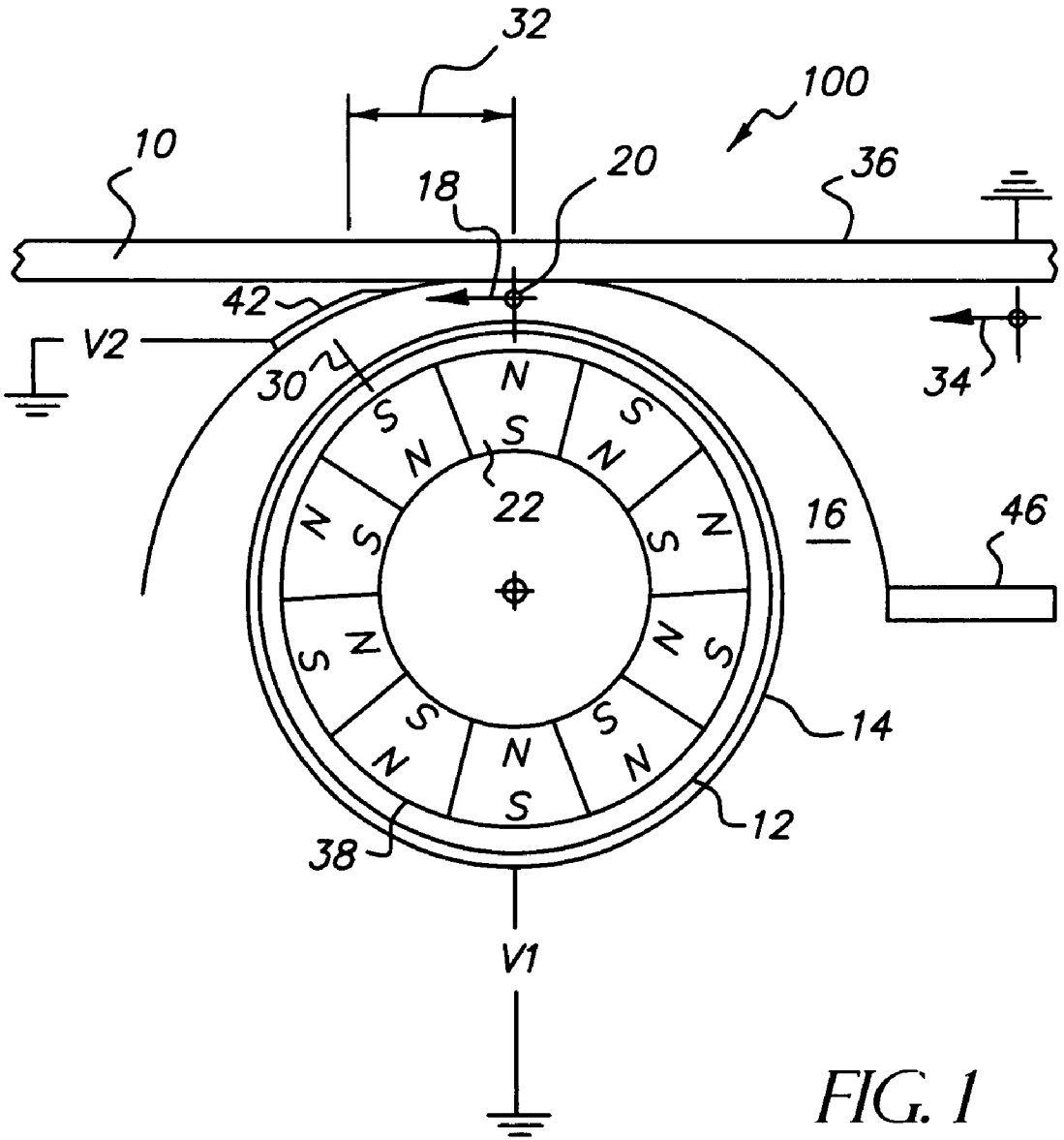
FIG. 1 presents a schematic of an apparatus for developing an electrographic image, according to an aspect of the invention.
Figure 2:
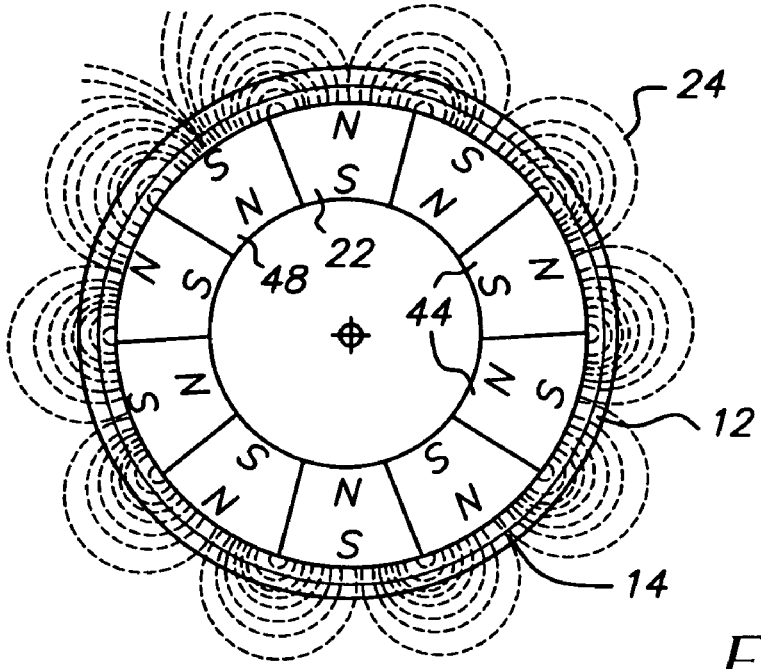
FIG. 2 presents a schematic of a magnetic core and toning shell with a representation of a magnetic field, according to a further aspect of the invention.
Figure 3:
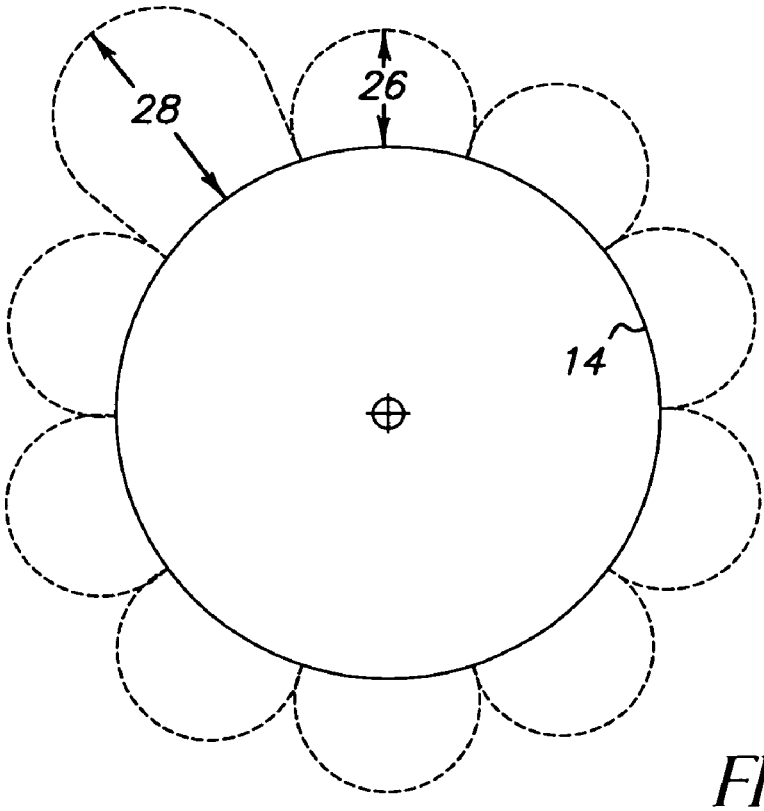
FIG. 3 presents a schematic of magnetic field strength around the toning shell outer circumference, according to a further aspect of the invention.

Various aspects of the invention are presented in FIGS. 1-7, which are not drawn to any particular scale, and wherein like components in the numerous views are numbered alike. As used herein, the terms "comprising", "having", and "including" are intended to have an open-ended meaning. Referring now specifically to FIG. 1, an electrographic development apparatus 100 is presented, according to an aspect of the invention. Apparatus 100 comprises a film 10 and a cylindrical toning shell 12 having an toning shell outer circumference 14. A 30 mixture of toner and carrier particles 16 is disposed on the cylindrical toning shell 12 in contact with the film 10. The cylindrical toning shell 12 is closest to the film at a first location 20, the mixture of toner and carrier particles 16 being movable through the first location with a flow direction 18. With reference to FIGS. 2 and 3, a magnetic core 22 is disposed within the cylindrical toning shell 12 that provides a magnetic field strength of varying magnitude around the toning shell outer circumference 14, the magnetic field strength having a first time-averaged absolute magnitude 26 at the first location 18, and a second time-averaged absolute magnitude 28 at a second location 30 a distance 32 from the first location 20 in the flow direction 18. The second time-averaged absolute magnitude 28 is greater than the first time-averaged absolute magnitude 26.

According to an aspect of the invention, the second time-averaged absolute magnitude 28 is at least 25 gauss greater than the first time-averaged absolute magnitude 26, or at least 50 gauss greater than the first time-averaged absolute magnitude 26, or at least 70 gauss greater than the first time-averaged absolute magnitude 26, or at least 100 gauss greater than the first time-averaged absolute magnitude 26, or at least 125 gauss greater than the first time-averaged absolute magnitude 26. According to a further aspect of the invention, the second time-averaged absolute magnitude 28 is at least 2.5% greater than the first time-averaged absolute magnitude 26, or at least 5% greater than the first time-averaged absolute magnitude 26, or at least 7% greater than the first time-averaged absolute magnitude 26, or at least 10% greater than the first time-averaged absolute magnitude 26, or at least 125% greater than the first time-averaged absolute magnitude 26. According to an aspect of the invention, increasing the magnetic field strength differential tends to decrease toning potential without increasing developer pick-up on the film.

The film 10 is any of the type known in the electrographic arts capable of carrying an electrostatic image, for example an electrophotoconductive film of the type generally used in electrophotographic image development. The film 10 is moved past the first location 20 in a film direction 34 with a film speed, as is well known in the art, using a known structure such as a film loop. The film typically comprises a ground reference 36, and a voltage V1 is applied to the toning shell 14 in order to generate an electrical field in the region of the first location 20 (the "toning nip") that draws or repels toner to the surface of the film 12 depending upon the charge carried by the film 12. In such manner, an electrostatic image is developed. The invention may be used with both Charged Area Development, and Discharged Area Development, as is described in U.S. Pat. No. 6,526,247 issued Feb. 25, 2003, to Stelter, Guth; Regelsberger and Eck, the contents of which are incorporated by reference as if set forth herein. The voltage V1 may be a static voltage and may have a superimposed alternating component that assists toning of the electrostatic image. A scavenger 42 may provided on the downstream side (in the flow direction 18) of the first location 20, that may be adjacent the second location 30, and is charged with a second voltage V2. An electrical field develops that assists in removing carrier particles adhering to film 10 since the film 10 is grounded through the ground reference 36. A skive 46 may be provided to meter the mixture of toner and carrier particles 16 onto the cylindrical toning shell 12.

Referring now to FIG. 2, the magnetic core 22, toning shell 12 are shown with a magnetic field 24. The magnetic core 22 comprises a plurality of magnets 44 that generate the magnetic field 24, B (the corresponding lines inside the magnetic core 22 are not shown). The magnitude of the magnetic field varies from positive to negative depending upon its direction. Referring now to FIG. 3, the absolute magnitude of B, the scalar quantity |B|, at the surface of the toning shell, is presented versus position around the toning shell outer circumference 14. The second time-averaged absolute magnitude 28 may be a maximum time-averaged absolute magnitude of magnetic field strength around the toning shell outer circumference 14, as is shown in FIG. 3, although this is not necessary in the practice of the invention.

In the example presented in FIGS. 1-3, the magnetic core 22 is fixed, cylindrical and concentric with the cylindrical toning shell 12, the magnet 48 is the strongest of the magnets 44, and the cylindrical toning shell 12 is rotated. As such, the magnetic field 24 at a given fixed location, for example first location 20 and second location 30, does not change as a function of time. Therefore the time-averaged absolute magnitude of the magnetic field strength is simply the absolute magnitude of the field strength at a given location. As will be discussed in more detail below, the magnetic core 22 may be rotated. In such case, the absolute magnitude of the magnetic field strength varies as a function of time and is time-averaged. The term "time-averaged absolute magnetic field strength" is intended to encompass time-varying and time-non-varying magnetic fields.

The carrier particles may comprise hard magnetic carrier particles. In such case, the magnetic brush may operate according to the principles described in U.S. Pat. Nos. 4,473,029 and 4,546,060, the contents of which are fully incorporated by reference as if set forth herein. The two-component dry developer composition of U.S. Pat. No. 4,546,060 comprises charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gin when in an applied field of 1000 gauss, is disclosed. As described in the '060 patent, the developer is employed in combination with a magnetic applicator comprising a rotatable magnetic core and an outer, nonmagnetizable shell to develop electrostatic images. When hard magnetic carrier particles are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the '060 flow smoothly and at a rapid rate around the shell while the core rotates in the opposite direction, thus rapidly delivering fresh toner to the photoconductor and facilitating high-volume copy and printer applications.

The mixture of toner and carrier particles 16 is typically movable by rotating either the cylindrical toning shell 12, or by rotating the magnetic core 22, or by rotating both the cylindrical toning shell 12 and the magnetic core 22 in the same or opposite directions. The cylindrical toning shell 12 or the magnetic core 22 may be fixed. With soft magnetic carriers, for example and without limitation, the magnetic core 22 may be fixed and the cylindrical toning shell 12 may be rotated in order to move the mixture of carrier and toner particles 16 into contact with the film 10 ("soft magnetic carriers" meaning magnetic carriers excluded by the definition of "hard magnetic carriers" set forth above).

Figure 4:
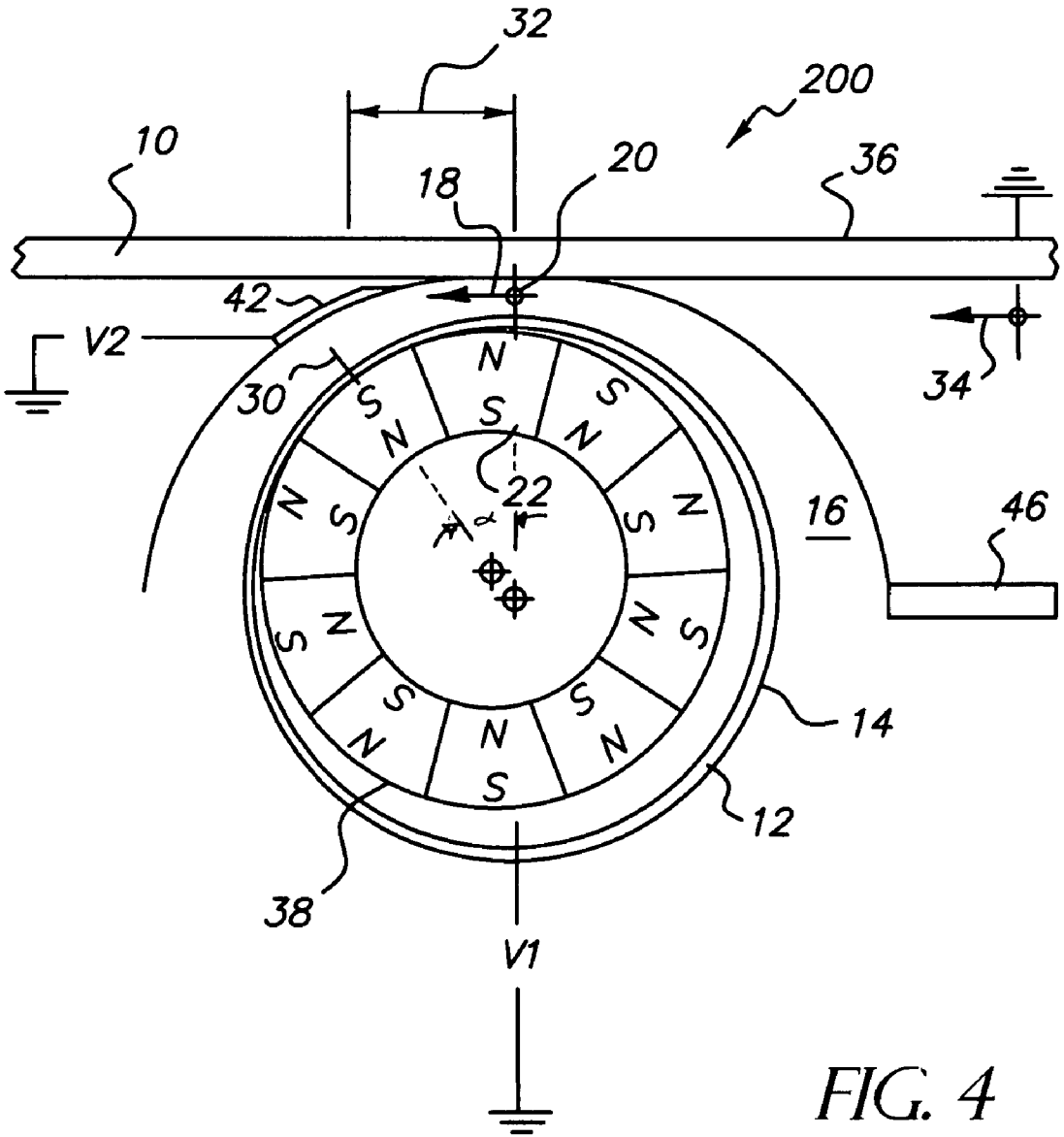
FIG. 4 presents a schematic of an apparatus for developing an electrographic image, according to an aspect of the invention.
Figure 5:
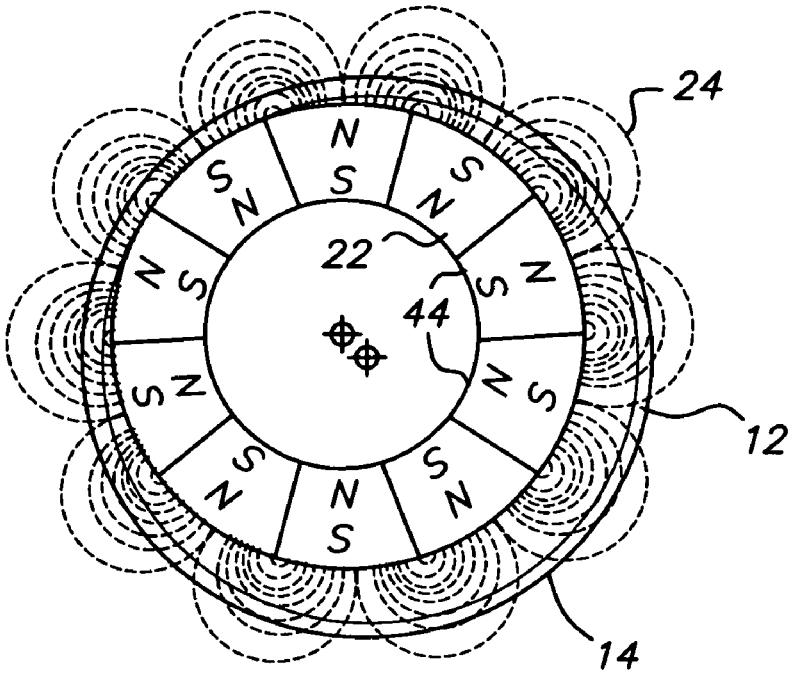
FIG. 5 presents a schematic of a magnetic core and toning shell with a representation of a magnetic field, according to a further aspect of the invention.
Figure 6:
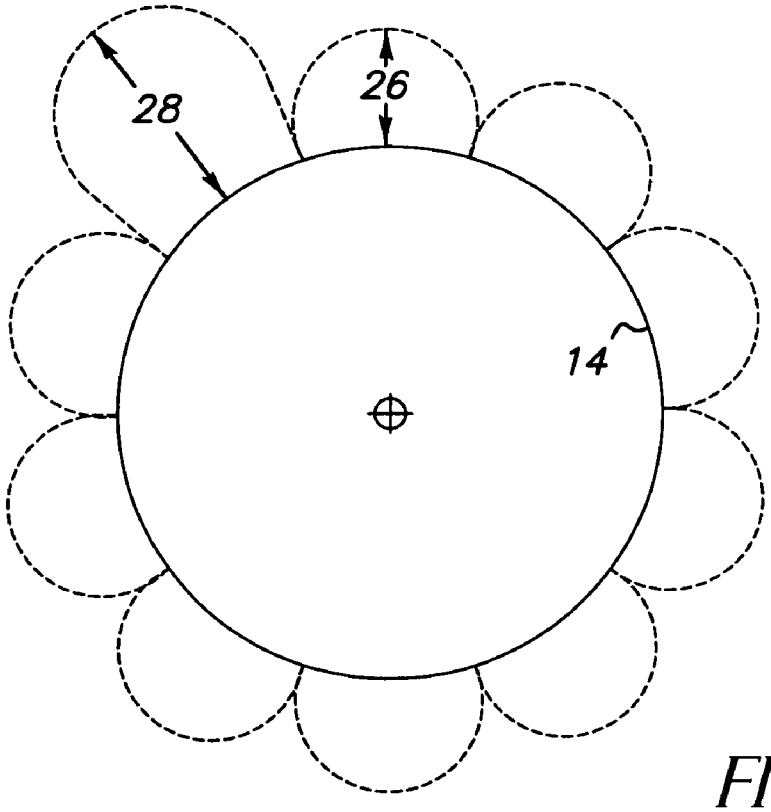
FIG. 6 presents a schematic of magnetic field strength around the toning shell outer circumference, according to a further aspect of the invention.

Referring now to FIGS. 4, 5 and 6, an apparatus 200 is presented similar to apparatus 100, except the magnetic core 22 is offset toward the cylindrical toning shell 12 such that the magnetic core 22 is closest to the cylindrical toning shell 12 at the second location 30. The magnetic core 22 may be cylindrical, and may comprise an outer magnetic core circumference 38 and a multitude of magnets 40 of uniform strength with alternating north and south poles disposed around the outer magnetic core circumference 38. In this example, the magnetic field varying magnitude around the toning shell outer circumference 14 is generated by the offset toward the cylindrical toning shell 12, as best shown in FIG. 5. Offsetting the magnetic core 22 toward the cylindrical shell downstream from the toning nip (a distance 32 in the direction of developer flow 18 through the first location 20) preferably increases the strength of the magnetic field on the downstream side and assists with removing carrier particles adhered to the film 10 and returning them to the mixture of developer and carrier particles 16. In a certain embodiment, the magnetic core 22 is disposed within the cylindrical toning shell 12 offset toward the cylindrical toning shell 12 such that the magnetic core 22 is closest to the cylindrical toning shell at the second location 30 the distance 32 from the first location 20 in the flow direction 18. The scavenger 42 may be provided to further assist with scavenging in order to minimize developer pick-up. Furthermore, offsetting the magnetic core 22 in the manner described herein may decrease the strength of the electrical field needed for adequate image development at the first location 20.

According to a further aspect of the invention, the cylindrical toning shell 12 and the magnetic core 22 (in this case cylindrical), are not concentric. The geometric center of the magnetic core 22 may be offset relative to the geometric center of the cylindrical toning shell 12 in the flow direction 18 an offset distance. This may be combined with an offset toward the first location 20. A line from the first location to the center of rotation to the second location may define an acute angle $\alpha$ greater than 20 degrees, at least 30 degrees, at least 45 degrees, or at least 60 degrees. This also applies to the position of the second location relative to the first location in FIG. 1.

According to a further aspect of the invention, an electrographic development method is provided, comprising moving the mixture of toner and carrier particles 16 disposed on the cylindrical toning shell 22 in contact with a film 10 in the flow direction 18 through a first location 20 wherein the cylindrical toning shell 12 is closest to the film 10, the magnetic core 22 being disposed within the cylindrical toning shell 12 that provides the magnetic field strength of varying magnitude around the toning shell outer circumference 14, the magnetic field strength having a first time-averaged absolute magnitude at the first location 20, and a second time-averaged absolute magnitude 30 at the second location 30 a distance from the first location 20 in the flow direction 18, the second time-averaged absolute magnitude being greater than the first time-averaged absolute magnitude.

According to a further aspect of the invention, an electrographic development method is provided, comprising moving the mixture of toner and carrier particles 16 disposed on the cylindrical toning shell 22 in contact with a film 10 in the flow direction 18 through a first location 20 wherein the cylindrical toning shell 12 is closest to the film 10, the magnetic core 22 being disposed within the cylindrical toning shell 12, the magnetic core 22 being disposed within the cylindrical toning shell 12 offset toward the cylindrical toning shell 12 such that the magnetic core is closest to the cylindrical toning shell at a second location 30 a distance 32 from the first location 20 in the flow direction 18.

Figure 7:
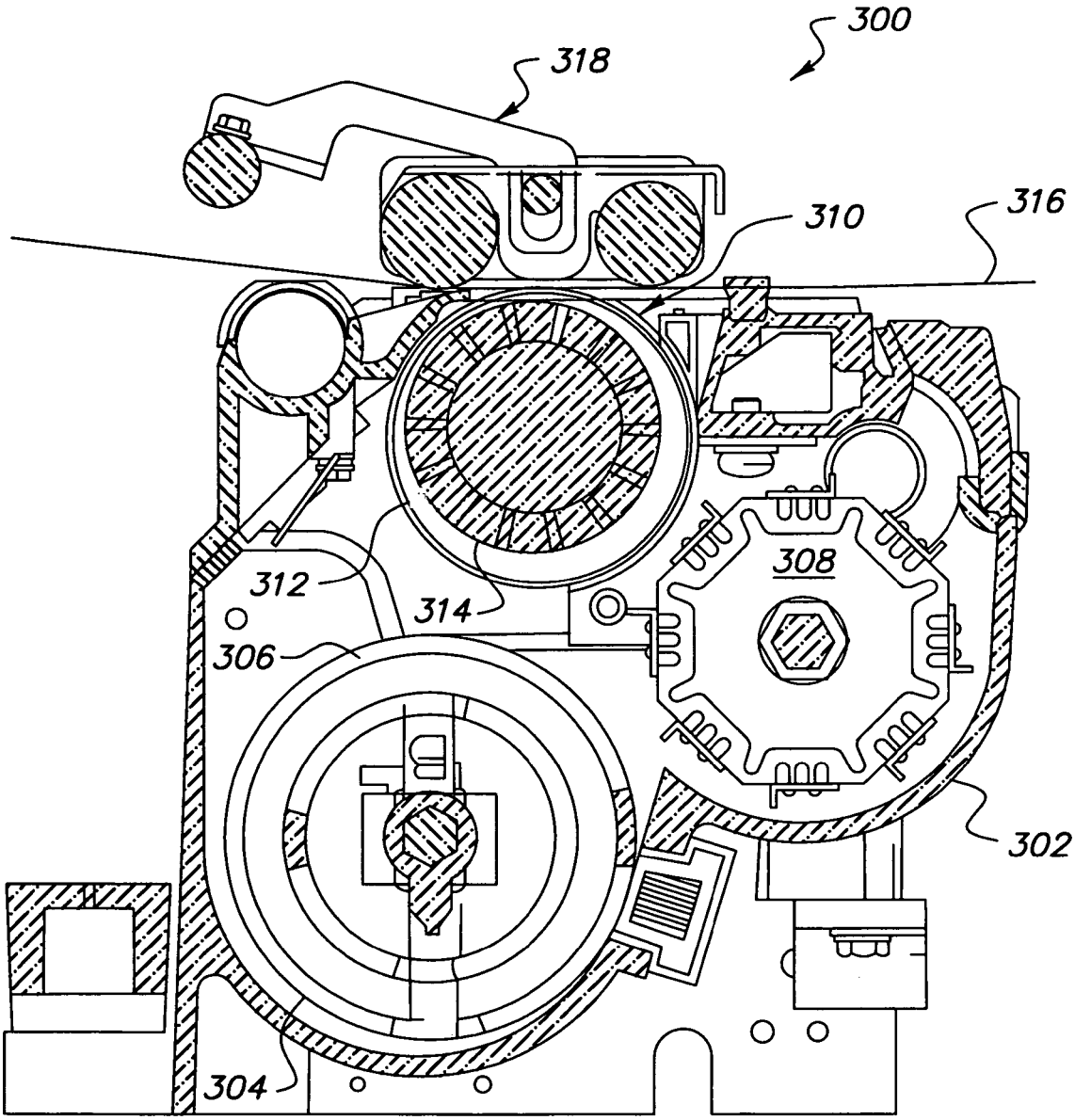
FIG. 7 presents a cross-sectional view of an apparatus for developing an electrographic image, according to an aspect of the invention.

Referring now to FIG. 7, a cross-sectional view of an electrographic developing apparatus 300 is presented implementing an blender 10 according to the invention. Toning station 300 comprises a housing 302 that defines a developer sump 304 containing a developer (not shown) that is a mixture of toner and hard magnetic carriers of a type described in U.S. Pat. No. 4,546,060. A ribbon blender 306 is rotated in the sump 304. The ribbon blender mixes and agitates the developer keeping it well mixed and also promoting tribocharging of the carrier and toner particles constituting the developer. A developer feed mechanism 308 lifts developer from the sump 304 to a magnetic brush 310. The magnetic brush is of a type described in U.S. Pat. No. 4,546,060 and comprises a toning shell 312 configured to rotate, and a core 314 having a plurality of magnets of alternating polarity that upon rotation of the core 314 cause the carrier particles to rotate in an opposite direction in an advancing nap coating the toning shell 312, as is well known in the art. The toning shell 312 may be rotated to contribute to the motion of the nap, again, as is well known in the art.

The advancing nap (not shown), constituting a magnetic brush, contacts a film 316 having a latent electrostatic image, generally a photoconductor as is known in the electrophotographic arts, and toner is attracted from the magnetic brush (developer) to the film 316 as it is advanced over the magnetic brush, thereby developing the image thereon. A backer bar 318 retains the film 316 in proper position relative to the toning shell, and in contact with the magnetic brush. The developer falls back into the sump 304. The blender according to the invention is preferably formed from a metal, for example aluminum.

The toner particles may comprise MICR (Magnetic Ink Character Recognition) toner particles. A suitable MICR toner is described in U.S. Pat. No. 6,610,451 entitled "DEVELOPMENT SYSTEMS FOR MAGNETIC TONERS HAVING REDUCED MAGNETIC LOADINGS", with about 23% iron oxide and 8% olfeinic wax by weight, and a silica surface treatment. The U.S. Pat. No. 6,610,451 is incorporated by reference as if fully set forth herein. A polymethylmethacrylate surface treatment may also be implemented, for example catalogue number MP1201 available from Soken Chemical & Engineering Co., Ltd., Tokyo, Japan, and distributed by Esprix Technologies of Sarasota, Fla. The carrier particles may be SrFe12019 coated with polymethylmethacrylate. Volume mean diameter of 20.5 microns (sigma=0.7 microns for ten production runs of a carrier material), measured using an Aerosizer particle sizing apparatus (TSI Incorporated of Shoreview, Minn.). A suitable carrier has a coercivity of 2050 Gauss, a saturation magnetization of 55 emu/g, and a remnance of 32 emu/g, measured using an 8 kG loop on a Lake Shore Vibrating Sample Magnetometer (Lake Shore Cryotronics, Inc., of Westerville, Ohio).

The sump in an electrographic developing apparatus 300 may have an average roughness of ten readings of 70 microinches Ra±20, with none of the ten readings being less than 20 microinches Ra or more than 120 microinches Ra, and 35 microinches Ra in the area of the toner monitor. The apparatus 300 may comprise a ribbon blender having an outside diameter of 2.760 inch, a toning shell having an outside diameter of 1.996 inch, a magnetic core of 1.700 inch. The magnetic core may have 14 magnets, a maximum magnetic field strength of 950 gauss and a minimum magnetic field strength of 850 gauss. At 110 pages per minute the ribbon blender may rotate 355 RPM, the toning shell may rotate at 129.1 RPM, and the magnetic core may rotate at 1141 RPM. At 150 pages per minute the ribbon blender may rotate 484 RPM, the toning shell may rotate at 176 RPM, and the magnetic core may rotate at 1555.9 RPM. The magnetic core may be shifted 0.050 inch toward the toning shell, and 0.050 inch in the flow direction (perpendicular to the shift toward the toning shell). Of course, other shifts are contemplated in the practice of the invention, for example 0.023 inch toward the toning shell, and 0.023 inch in the flow direction (perpendicular to the shift toward the toning shell).

In operating the apparatus 300 with MICR toner, the voltage V1 may configured as a bias on the order of 86 volts relative to the film charging potential, the film charging potential generally being in the range of 300-750 volts and discharging to a voltage on the order of 100 volts upon exposure to an infrared light emitting diode. The toner is fused at a temperature on the order of 375 degrees F., and the developer may be exercised for a period of time on the order of 1.5 minutes prior to initializing toning in order to reduce densification. The scavenger may be charged with a voltage V2 on the order of 900 volts DC with 600 volts AC superimposed.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. An electrographic development apparatus, comprising:

a film;

a cylindrical toning shell having an toning shell outer circumference;

a mixture of toner and carrier particles disposed on the cylindrical toning shell in contact with the film, the cylindrical toning shell being closest to the film at a first location, the mixture of toner and carrier particles being movable through the first location with a flow direction;

a nonconcentric magnetic core disposed within the cylindrical toning shell that provides a magnetic field strength of varying magnitude around the toning shell outer circumference, the magnetic field strength having a first time-averaged absolute magnitude at the first location, and a second time-averaged absolute magnitude at a second location a distance from the first location in the flow direction, the second time-averaged absolute magnitude being greater than the first time-averaged absolute magnitude; and a scavenger adjacent the second location.

2. The apparatus of claim 1, wherein the second time-averaged absolute magnitude is a maximum time-averaged absolute magnitude of magnetic field strength around the toning shell outer circumference.

3. The apparatus of claim 1, wherein the magnetic core is either fixed or rotatable.

4. The apparatus of claim 1, wherein the cylindrical toning shell is either fixed or rotatable.

5. The apparatus of claim 1, wherein the magnetic core is cylindrical, comprising an outer magnetic core circumference and a multitude of magnets of uniform strength with alternating north and south poles disposed around the outer magnetic core circumference.

6. The apparatus of claim 5, wherein the magnetic core is offset toward the cylindrical toning shell such that the magnetic core is closest to the cylindrical toning shell at the second location.

7. The apparatus of claim 1, wherein the carrier particles comprise hard magnetic carrier particles.

8. The apparatus of claim 1, wherein the toner particles comprise MICR toner particles.

9. An electrographic development method, comprising:

moving a mixture of toner and carrier particles disposed on a cylindrical toning shell in contact with a film in a flow direction through a first location wherein the cylindrical toning shell is closest to the film, a nonconcentric magnetic core being disposed within the cylindrical toning shell that provides a magnetic field strength of varying magnitude around the toning shell outer circumference, the magnetic field strength having a first time-averaged absolute magnitude at the first location, and a second time-averaged absolute magnitude at a second location a distance from the first location in the flow direction, the second time-averaged absolute magnitude being greater than the first time-averaged absolute magnitude; and a scavenger being adjacent the second location.

10. The method of claim 9, comprising rotating the magnetic core.

11. The method of claim 9, comprising rotating the toning shell.

12. The method of claim 9, wherein the carrier particles comprise hard magnetic carrier particles.

13. The method of claim 9, wherein the toner particles comprise MICR toner particles.

14. An electrographic development apparatus, comprising:

a film;

a cylindrical toning shell defining a center of rotation;

a mixture of toner and carrier particles disposed on the cylindrical toning shell in contact with the film, the cylindrical toning shell being closest to the film at a first location, the mixture of toner and carrier particles being movable through the first location with a flow direction; and, a nonconcentric magnetic core disposed within the cylindrical toning shell offset toward the cylindrical shell such that the magnetic core is closest to the cylindrical toning shell at a second location a distance from the first location in the flow direction such that a line from the first location to the center of rotation to the second location defines an acute angle greater than 20 degrees.

15. The apparatus of claim 14, the acute angle being at least 30 degrees.

16. The apparatus of claim 14, the acute angle being at least 45 degrees.

17. The apparatus of claim 14, the acute angle being at least 60 degrees.

18. The apparatus of claim 14, wherein the carrier particles comprise hard magnetic carrier particles.

19. The apparatus of claim 14, wherein the toner particles comprise MICR toner particles.

20. The apparatus of claim 14, wherein the cylindrical toning shell is either rotatable or fixed.

21. The apparatus of claim 14, wherein the magnetic core is either rotatable or fixed.

22. An electrographic development method, comprising:

moving a mixture of toner and carrier particles disposed on a cylindrical toning shell in contact with a film in a flow direction through a first location wherein the cylindrical toning shell is closest to the film, the cylindrical toning shell defining a center of rotation, a nonconcentric magnetic core being disposed within the cylindrical toning shell offset toward the cylindrical toning shell such that the magnetic core is closest to the cylindrical toning shell at a second location a distance from the first location in the flow direction such that a line from the first location to the center of rotation to the second location defines an acute angle greater than 20 degrees.

23. The method of claim 22, the acute angle being at least 30 degrees.

24. The method of claim 22, the acute angle being at least 45 degrees.

25. The method of claim 22, the acute angle being at least 60 degrees.

26. The method of claim 22, wherein the carrier particles comprise hard magnetic carrier particles.

27. The method of claim 22, wherein the toner particles comprise MICR toner particles.

28. The method of claim 22, comprising rotating the cylindrical toning shell.

29. The method of claim 22, comprising rotating the magnetic core.

30. An electrographic development apparatus, comprising:

a film;

a cylindrical toning shell defining a center of rotation;

a mixture of toner and carrier particles disposed on the cylindrical toning shell in contact with the film, the cylindrical toning shell being closest to the film at a first location, the mixture of toner and carrier particles being movable through the first location with a flow direction, the mixture of toner and carrier particles comprising hard magnetic carriers; and, a nonconcentric magnetic core disposed within the cylindrical toning shell offset toward the cylindrical shell such that the magnetic core is closest to the cylindrical toning shell at a second location a distance from the first location in the flow direction such that a line from the first location to the center of rotation to the second location defines an acute angle greater than 20 degrees, the magnetic core being rotatable.

31. The apparatus of claim 30, wherein the toner particles comprise MICR toner particles.

* * * * *